US010465464B2

(12) United States Patent
Campbell

(10) Patent No.: US 10,465,464 B2
(45) Date of Patent: Nov. 5, 2019

(54) APPARATUS AND METHOD FOR CREATING TUNABLE PRESSURE PULSE

(71) Applicant: Charles Abernethy Anderson, Millarville (CA)

(72) Inventor: Josh Campbell, Calgary (CA)

(73) Assignee: Charles Abernethy Anderson (CA)

( * ) Notice: Subject to any disclaimer, the term of this patent is extended or adjusted under 35 U.S.C. 154(b) by 118 days.

(21) Appl. No.: 14/895,716

(22) PCT Filed: Sep. 19, 2014

(86) PCT No.: PCT/CA2014/000701
§ 371 (c)(1),
(2) Date: Feb. 27, 2017

(87) PCT Pub. No.: WO2016/041049
PCT Pub. Date: Mar. 24, 2016

(65) Prior Publication Data
US 2017/0191325 A1 Jul. 6, 2017

(51) Int. Cl.
*E21B 28/00* (2006.01)
*E21B 7/24* (2006.01)
*E21B 4/02* (2006.01)

(52) U.S. Cl.
CPC ..... *E21B 28/00* (2013.01); *E21B 4/02* (2013.01); *E21B 7/24* (2013.01)

(58) Field of Classification Search
CPC ... E21B 28/00; E21B 4/02; E21B 4/14; E21B 7/24
See application file for complete search history.

(56) References Cited

U.S. PATENT DOCUMENTS

| | | | | |
|---|---|---|---|---|
| 6,431,294 | B1 * | 8/2002 | Eddison | E21B 4/14 175/415 |
| 6,439,318 | B1 * | 8/2002 | Eddison | E21B 7/18 173/91 |
| 6,854,953 | B2 * | 2/2005 | Van Drentham-Susman | E21B 4/02 175/107 |
| 8,162,078 | B2 * | 4/2012 | Anderson | E21B 7/24 166/177.2 |
| 8,167,051 | B2 * | 5/2012 | Eddison | E21B 21/103 166/177.7 |
| 9,222,312 | B2 * | 12/2015 | Anderson | E21B 7/24 |
| 9,382,760 | B2 * | 7/2016 | Le | E21B 23/14 |
| 10,024,102 | B2 * | 7/2018 | Mitchell | E21B 4/02 |
| 2017/0159387 | A1 * | 6/2017 | Johnson | E21B 31/005 |
| 2018/0010389 | A1 * | 1/2018 | Campbell | E21B 4/14 |
| 2018/0283122 | A1 * | 10/2018 | Campbell | E21B 31/005 |

OTHER PUBLICATIONS

International Search Report, PCT/CA2014/000701, dated Jun. 1, 2015.

* cited by examiner

*Primary Examiner* — Nicole Coy
(74) *Attorney, Agent, or Firm* — Scott T. Griggs; Griggs Bergen LLP

(57) ABSTRACT

Embodiments disclosed herein relate to downhole tools capable of creating a vibration, and more particularly to methods and apparatus for creating tunable pressure pulses for imparting vibration to a downhole drill string.

14 Claims, 13 Drawing Sheets

APPARATUS AND METHOD FOR CREATING TUNABLE PRESSURE PULSE

CROSS-REFERENCE TO RELATED APPLICATION

This application is the National Stage of, and therefore, claims the benefit of, International Application No. PCT/CA2014/000701 filed on Sep. 19, 2014, entitled "Apparatus and Method for Creating Tunable Pressure Pulse" which is hereby incorporated by reference for all purposes.

FIELD

Embodiments disclosed herein relate to downhole tools capable of creating a vibration, and more particularly to methods and apparatus, for creating tunable pressure pulses for imparting vibration to a downhole drill string.

BACKGROUND

In the oil and gas industry, oil producers access subsurface hydrocarbon-bearing formations by drilling long bore holes into the earth from the surface. Conventional drilling comprises advancing a rotating drill bit through the hole, the bit being mounted on a bottom hole assembly at the distal end of a drill string. During drilling, friction between the downhole assembly and the earth can impair the rate of penetration in the hole. In particular, where highly deviated holes or horizontal holes are being drilled, the weight of the drill pipe alone cannot be relied upon to overcome friction from the string resting against the wall of the hole.

One means for overcoming downhole friction is to impart a vibration or movement to the drill string. For example, the "AG-itator" tool disclosed in U.S. Pat. No. 8,167,051 comprises the use of a 1:2 lobe Moineau principle positive displacement motor (PDM) to control a valve arrangement that oscillates in and out of alignment as the pump snakes back and forth. Oscillation of the valve arrangement causes an increase in fluid pressure (as the valve closes) and corresponding release of pressure (as the valve opens), creating a pressure pulse capable of vibrating the string. The pressure pulse magnitude and frequency of such tools, however, are limited by the tool design. Other conventional tools operate by creating backpressure in the fluid supply. These tools require supply pumps of greater capacity and also reduce the supply pressure to the drilling bit.

U.S. patent application Ser. No. 13/381,297 teaches a "Rattler" vibration tool that induces movement of the string by reducing the overall fluid pressure within the drill string, creating a negative pressure pulse. In the Rattler tool, drilling fluid is pumped down the drill string and then cyclically vented from the tool to the annulus through a fluid port disposed in the side wall of the tool. This tool, however, teaches the use of a turbine-type rotor in the tool body, resulting in a limited size and frequency pressure pulse that can be achieved (that is—venting of fluid from the tool is limited to the available fluid pressure that can be vented, and the corresponding pressure drop directly correlates to the uncontrolled speed of the "spinning" turbine-type rotor).

Known vibration tools are not, capable of providing controlled, tunable pressure fluctuations, that is—the magnitude and frequency of pulses created by known tools is fixed according to the size and capacity of the tool. Other known tools are also often reliant upon downstream pressure losses and are unable to create a sufficient vibration where downstream pressure is low.

There is a need for a downhole vibration tool that is capable of providing a higher magnitude controlled pressure pulse, enabling operators to dictate the intensity and frequency of the vibration, without the need to modify the fluid flow rate through the tool and without any reliance on downstream fluid pressures.

SUMMARY

Embodiments herein describe a pressure pulse tool that is adaptable for use in different drilling operations. For example, the present tool may be configured for use in downhole vibration scenarios, extended reach or casing scenarios, for use with hammer sub tools, to create high magnitude pressure pulses, as a power source for certain applications including a motor for a hammer or percussion drill, or as a means of cycling an adjustable stabilizer. It is understood that, where desired, the pressure profile achieved by the tool can, be varied to alter the amplitude and frequency of the pulse (e.g. to create sharp or gradual vibration), whether the tool is operable in one downhole application or adapted for use in different applications.

Apparatus and methods herein describe means for achieving a tunable negative pressure pulse (i.e. a pulse in the negative direction) by controllably restricting the fluid flowing through the tool (e.g. via fixed restrictor or a valve arrangement) in combination with controllably venting of the fluid from the tool. It will be understood that although venting of fluid from the tool alone provides a nominal pressure drop, controlling the pressure of un-vented fluid flow through the tool, whether in a fixed or variable manner, in combination with the controlled venting can significantly increase the magnitude of the pressure pulse created.

In embodiments herein, the present tool may be used alone, in combination with other vibration tools in a stacked arrangement, or in combination with one or more downhole tools.

The above-mentioned and other features of the present apparatus and methodology will be best understood by reference to the following description of the embodiments.

DESCRIPTION OF THE EMBODIMENTS

Embodiments herein relate to apparatus and methodology of controllably modifying the pressure of drilling fluid through a downhole vibration tool, allowing operators to dictate the size and frequency of the pressure pulses achieved and enabling the present apparatus and methodology to be used in a variety of different downhole applications. The present apparatus and method will now be described having regard to FIGS. 1-11.

Figure 1:
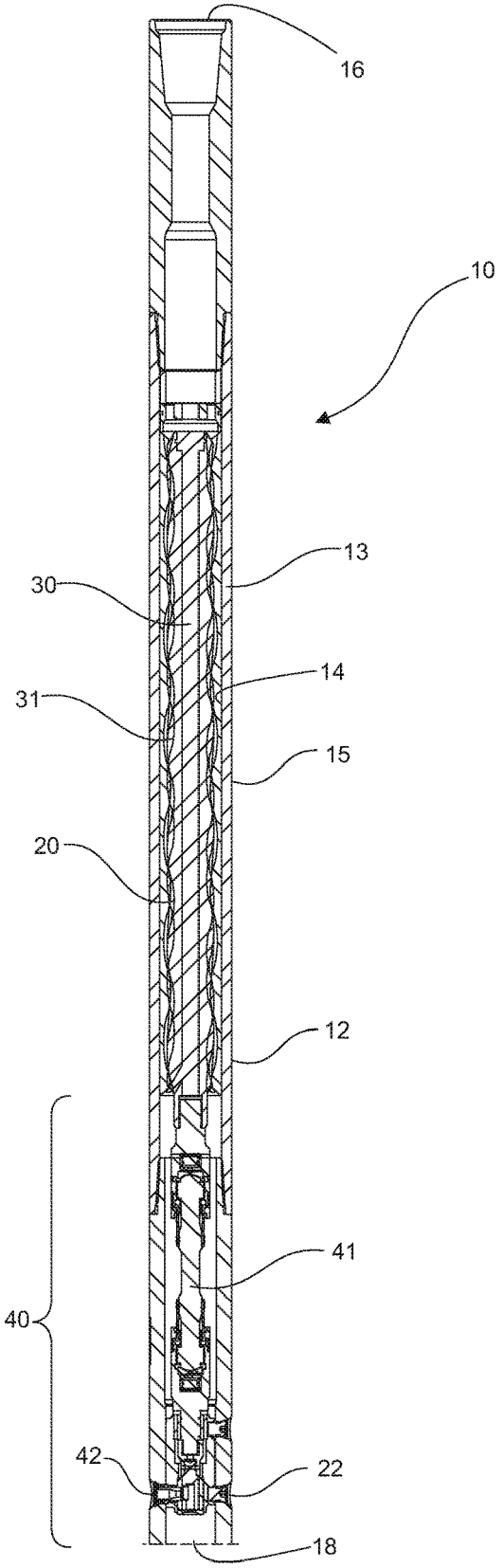
FIG. 1 is a cross sectional side view of the present tool according to a first embodiment herein.
Figure 2:
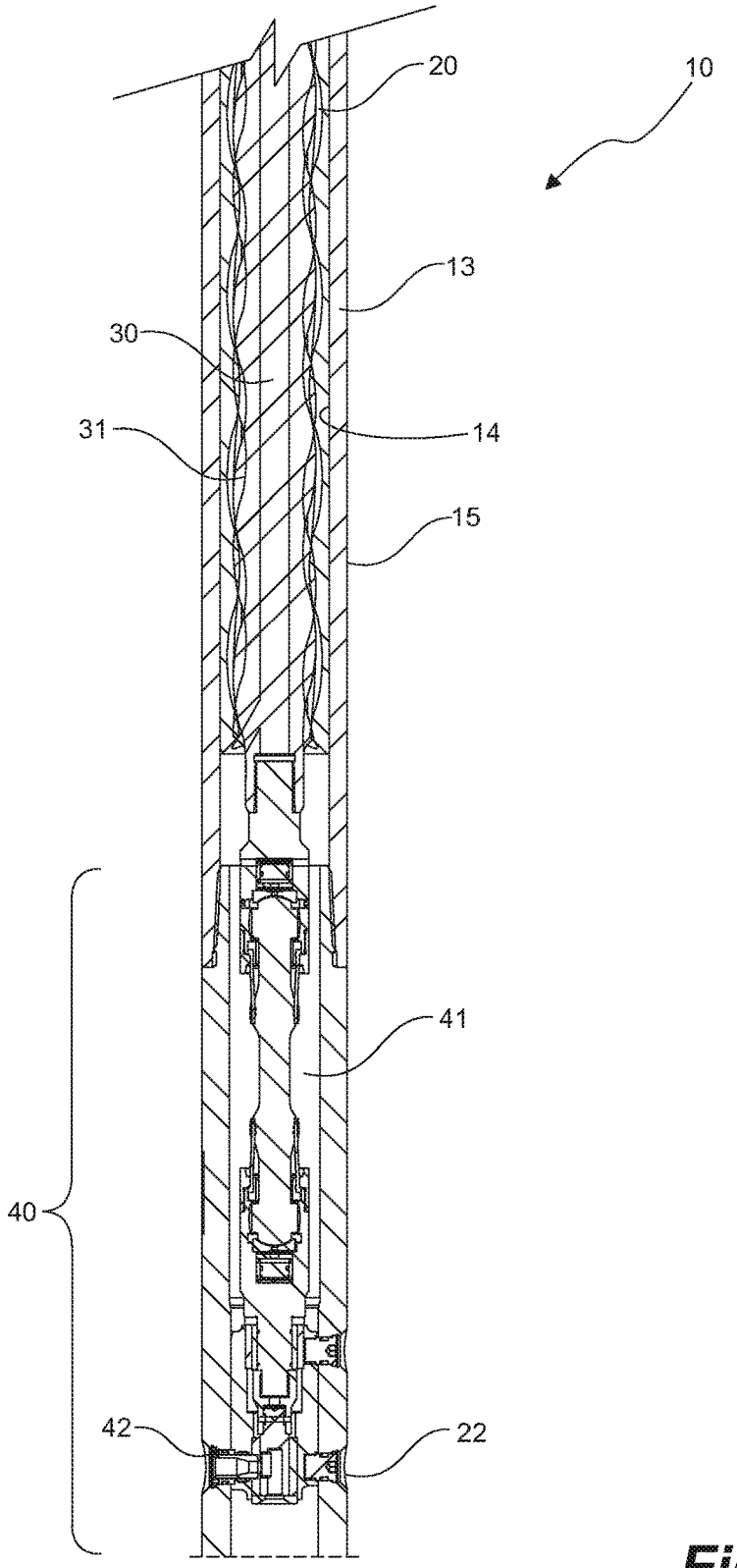
FIG. 2 is a magnified cross sectional side view of the tool in FIG. 1.

Having regard to FIGS. 1 and 2, embodiments described herein relate to a vibration tool 10 incorporated in a drilling fluid transmitting downhole apparatus (e.g. drill string, coil tubing, casing string etc.) positioned within a bore hole. The tool 10 comprises a housing 12 adapted to permit the passage of drilling fluid therethrough, the housing 12 having a cylindrical wall 13 with inner and outer surfaces 14,15 extending between an upper inlet end 16 and a lower (downhole) outlet end 18. The inlet and outlet ends 16,18 of the housing 12 can include interior and exterior threading, as is known in the art, for connecting the housing 12 with the drill string. Interior and exterior threading may be of conventional type, such as pin/box type to facilitate ready connection with the drill string. Housing 12 can be of steel construction, or any other suitable material, and can be surface hardened for durability and abrasion resistance.

Housing 12 defines a central bore 20, and housing wall 13 forms at least one first fluid port 22, having a generally circular cross section, extending through the wall 13 from the central bore 20 to the annulus. It is contemplated that fluid port 22 may be configured to optionally receive fluid port inserts (not shown), altering the internal diameter thereof.

Housing 12 is configured to receive drive means (e.g. mud motor) within bore 20 for pumping drilling fluid received from the drill string downwards through the tool 10. While it is understood that any suitable drive means can be used, embodiments herein illustrate the use of a positive displacement pump 30 having a rotor 31.

Housing 12 is further configured to receive a fluid vent assembly 40 within bore 20, the vent assembly 40 comprising a body 41 affixed to the lower end of the pump 30 and movable therewith (e.g. in the case of the positive displacement pump 30, vent assembly 40 can be rotable therewith). Fluid vent assembly 40 forms at least one second fluid port 42, corresponding with first fluid port 22 of housing 12, such that when first and second fluid ports 22,42 are in alignment, fluid can be vented from the tool 10 to the annulus. For example, in the case of a rotating fluid vent assembly 40, as body 41 within central bore 20, first and second fluid ports 22,42 revolve in and out of alignment to cyclically vent drilling at least a portion of the fluid passing through the tool 10 to the annulus. It is understood that second fluid port 42, and ultimately the venting window formed by ports 22,42, can configured in any manner with any internal diameter size or shape to further control the pressure pulse profile.

More specifically, in operation, the rate of drilling fluid flowing through the tool 10 is determined by the rate of the pump 30 and remains constant. The velocity of said fluid flow through the tool, however, can be dictated according to predetermined and desire pressure pulse profiling. For example, as fluid ports 22,42 rotate out of alignment, fluid pressure within the tool 10 increases until ports 22,42 align again and at least a portion of the pressurized fluid is released from the tool 10. This "venting" of fluid from the tool 10 to the annulus provides for a means of creating a pressure pulse (or vibration) while maintaining a constant fluid flow rate through tool 10 and regardless of the downstream pressure.

Although the venting of fluid from the tool 10 alone provides a nominal pressure drop, it was determined that further modifying the velocity of the fluid flow through the tool 10 (e.g. via fixed or variable fluid restriction) in combination with the venting enabled the dictation of pressure pulse profiles to allow for controlled tenability of pulse frequency, pulse profile (e.g. sharp or gradual pulses) and significantly greater pulse intensity.

More specifically, in operation, in addition to the recurrent venting of fluid from the tool 10, the velocity of at least a portion of the un-vented fluid flowing through the tool 10 can be restricted in a fixed or variable manner, providing a larger release of fluid pressure upon venting of fluid from the tool 10 (that is—providing a larger pressure release in the negative direction upon venting from the tool). This increased pressure is again achieved without the need to alter the fluid flow rate through the tool, and regardless of the downstream pressure.

In one embodiment, fluid flow through the tool 10 may be modified by controlling the velocity of fluid passing through outlet end 18 of the tool 10. For example, a fluid flow restrictor 50 can be provided downstream of vent assembly 40 for restricting at least a portion of the un-vented flowing through the tool 10. It is contemplated that one or more fluid flow restrictors 50 may be positioned upstream, within (e.g., substantially adjacent, or downstream of fluid vent assembly 40.

Figure 3:
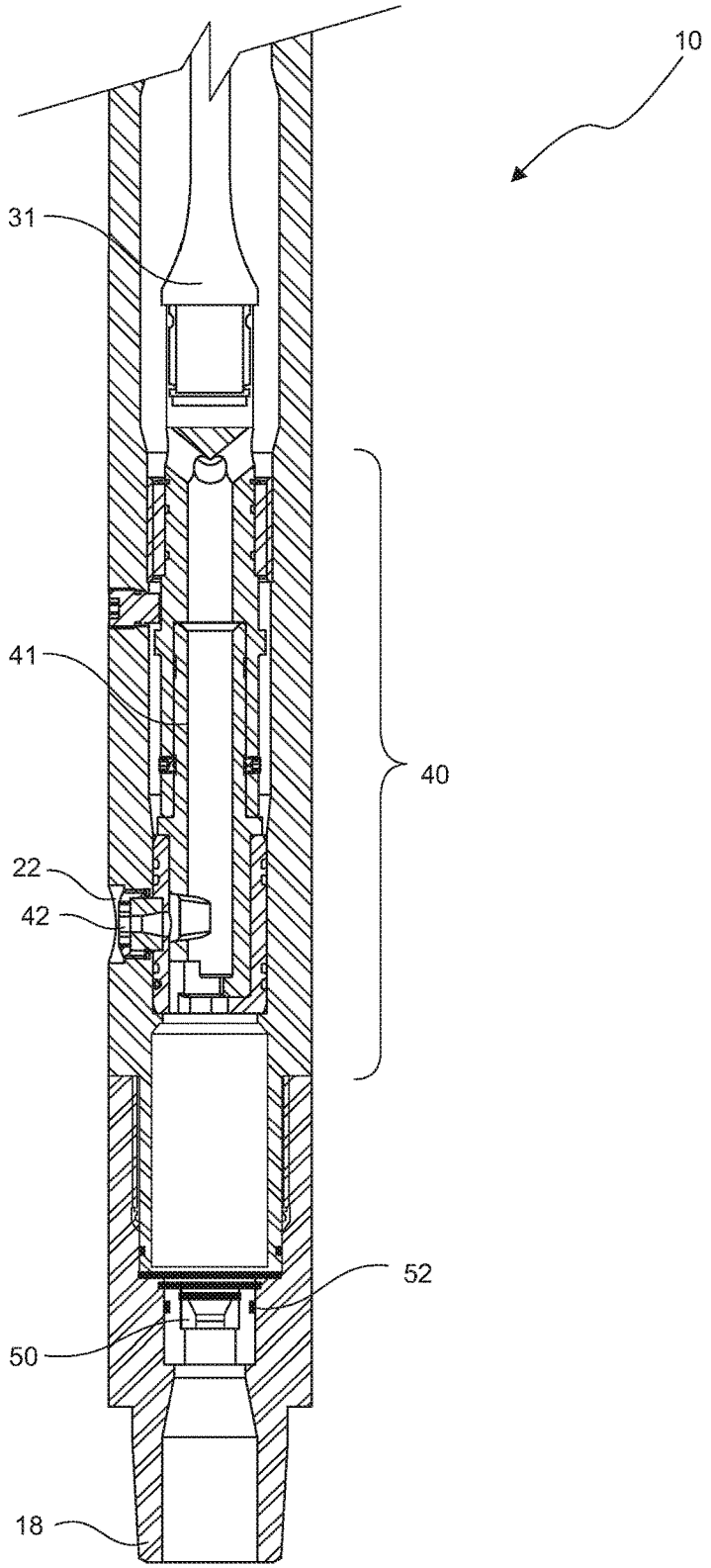
FIG. 3 is a cross sectional side view of the present tool according to a second embodiment herein (e.g. showing a fixed fluid restriction port)
Figure 4:
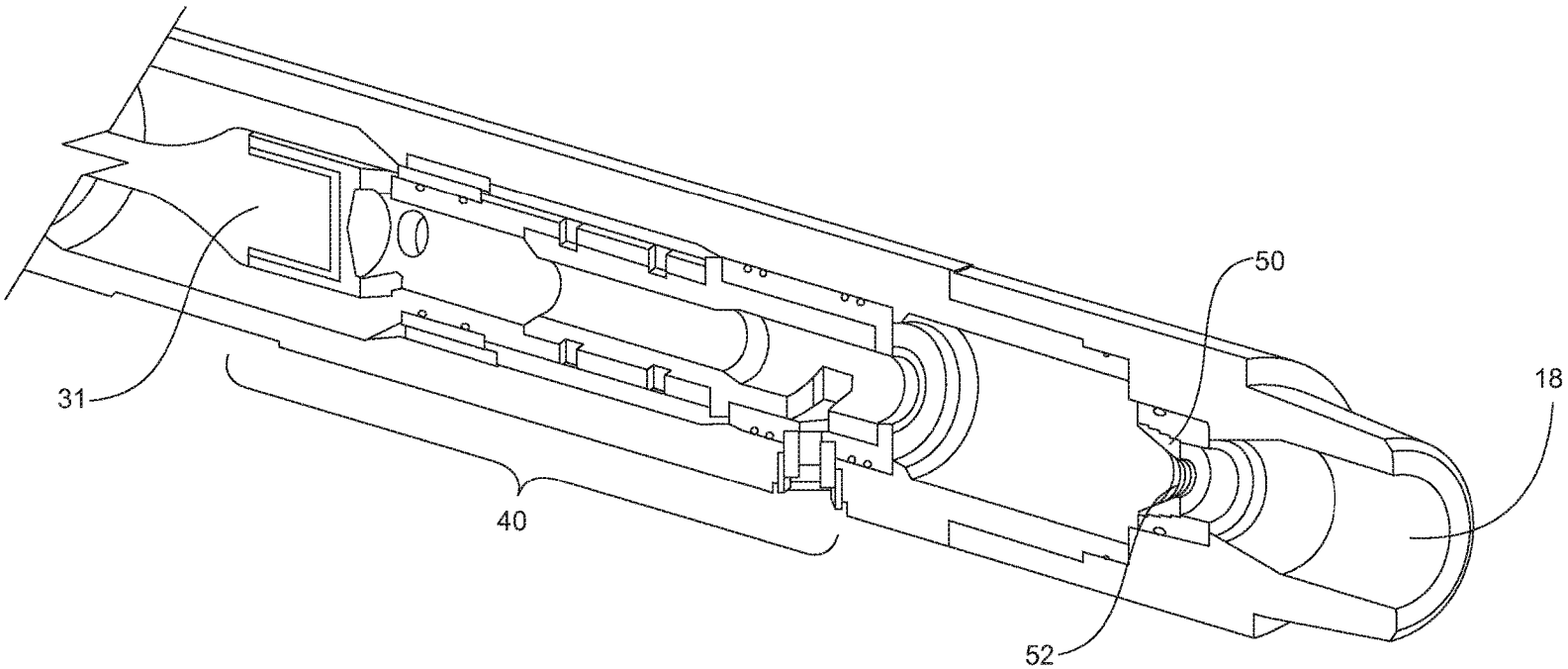
FIG. 4 is a magnified cross sectional perspective view of the tool in FIG. 3.
Figure 5:
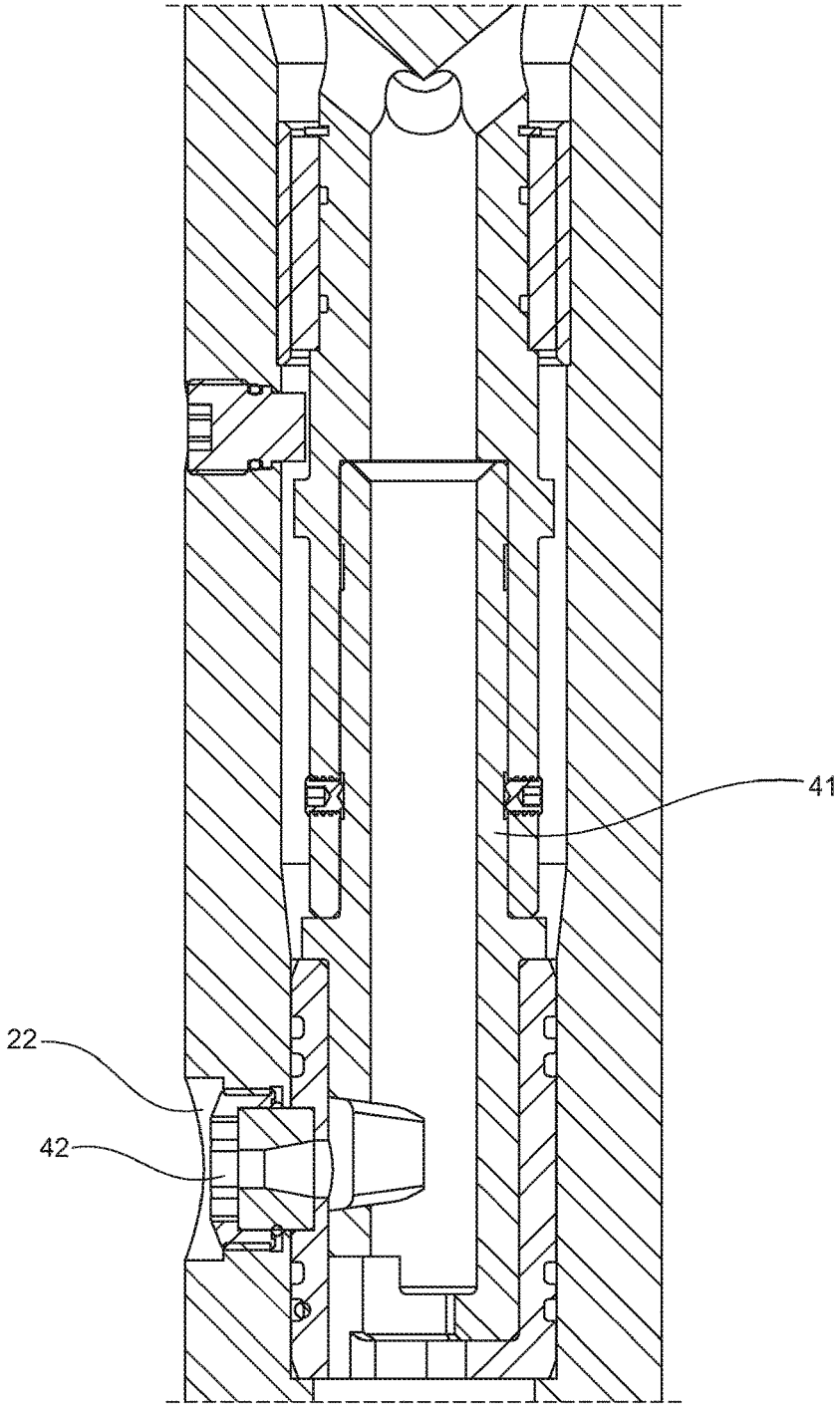
FIG. 5 shows cross sectional side view of the present tool according to a third embodiment herein (e.g. showing a variable fluid, restriction port), the tool being in the "open" or "venting" position.
Figure 6:
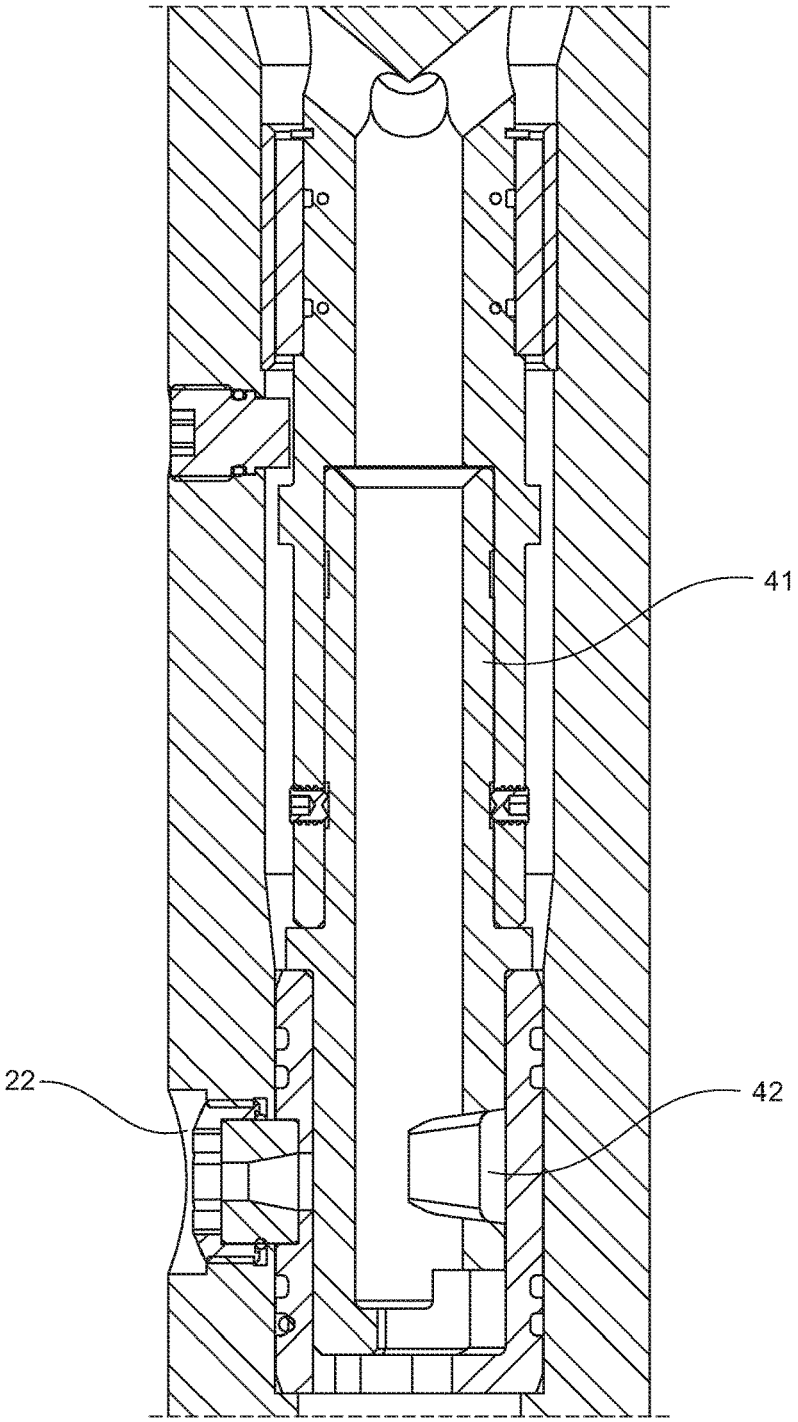
FIG. 6 shows cross sectional side view of the tool according to the third embodiment herein, the tool being in the "closed" position.

Having regard to FIGS. 3 and 4, in embodiments herein, fluid flow restrictor 50 may be a fixed restrictor such as, for example, a fluid port 52 having a known, predetermined shape and constant fluid flow area (i.e. internal diameter). Without limitation, fluid flow area of fluid flow restrictor 50 can be limited only by the internal diameter of the downhole apparatus as a maximum and allowing fluid flow through the tool 10 as a minimum. Fixed fluid flow restrictor 50 may be configured according to the desired pressure pulse profile.

Figure 7:
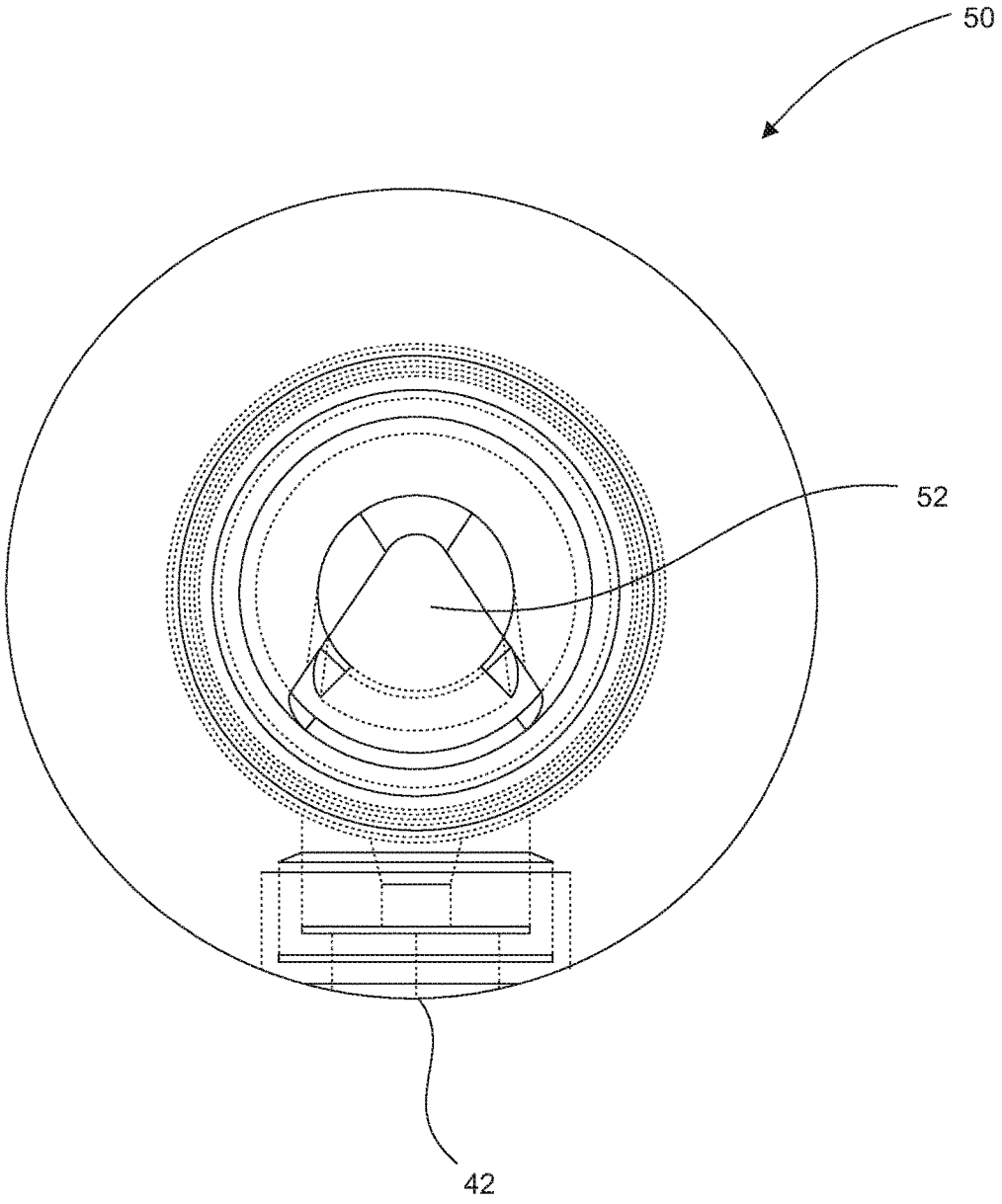
FIG. 7 shows a top down view of one example of a variable fluid flow restrictor, the restrictor being in the "open" position.
Figure 8:
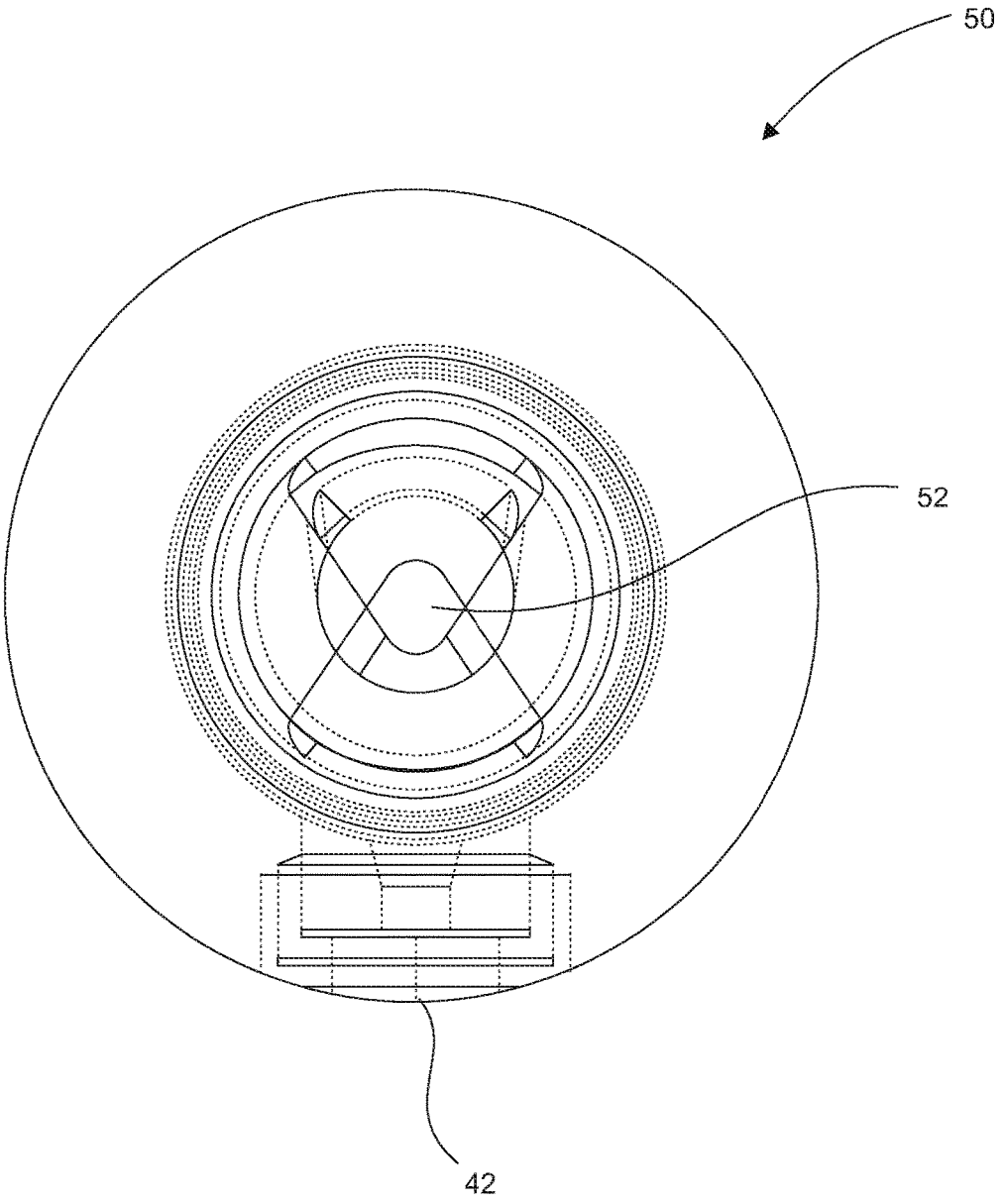
FIG. 8 shows a top down view of the fluid flow restrictor in FIG. 7, the restrictor being the "closed" position.
Figure 9:
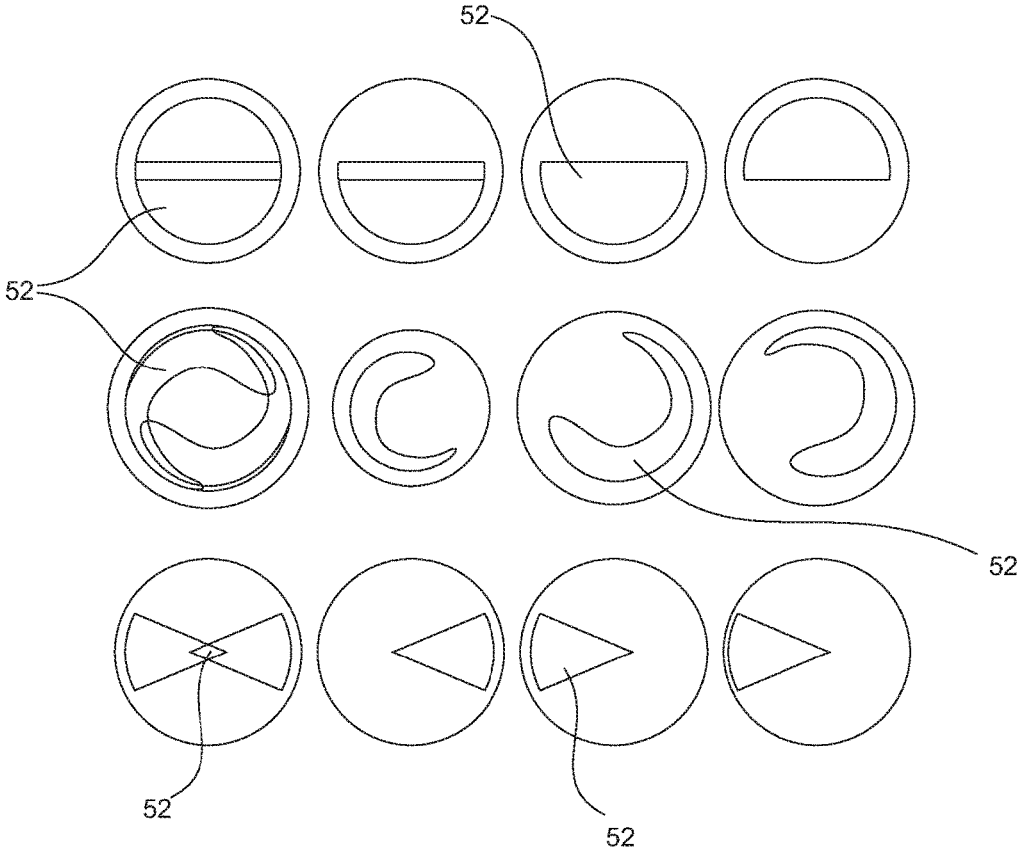
FIG. 9 shows cross sectional top down views of variable fluid flow restrictors according to contemplated embodiments herein.

Having regard to FIGS. 5-8, in other embodiments herein, fluid flow restrictor 50 may be a variable in size and shape according to the predetermined pressure pulse profile such as, without limitation, a valve arrangement including a rotating, axially oscillating, or orbiting valve arrangement (or other suitable arrangement, e.g. intersecting venting windows). It is understood that any fluid flow restriction arrangement capable of achieving the desired control of fluid velocity may be used. A skilled person would know and understand that any restrictor arrangement having an eccentric running surface that can be used to allow fluid flow to be vented when the eccentric surface is orbiting off of the fluid restrictor can be used. For example, FIG. 7 shows a top down view of one example of a variable fluid flow restriction port 52 in the "open" position having a large, triangular fluid passage area, while FIG. 8 provides a top down view of the same variable restrictor port 52 in the "closed" or "restricted" position. FIG. 9 provides examples, without limitation, of other contemplated variable fluid flow restriction port 52 embodiments. Varying the profile of the fluid flow restrictor 52 of the present tool 10, in combination with the controlled venting of fluid from said tool 10, was determined to enable the ability to dictate vibrations having various frequencies and intensities, including, for example:

a) a sharp, abrupt vibration, b) a vibration comprised of a slow increase in intensity followed by a large, rapid pulse, or c) a vibration comprised of a fast accumulation of intensity followed by a slow vibration.

Accurate tuning of pressure pulse profiles can be used to manipulate how energy is used/conserved in the tool 10, and to control how the profile is created for different applications (e.g. hammer effects).

Figure 10A:
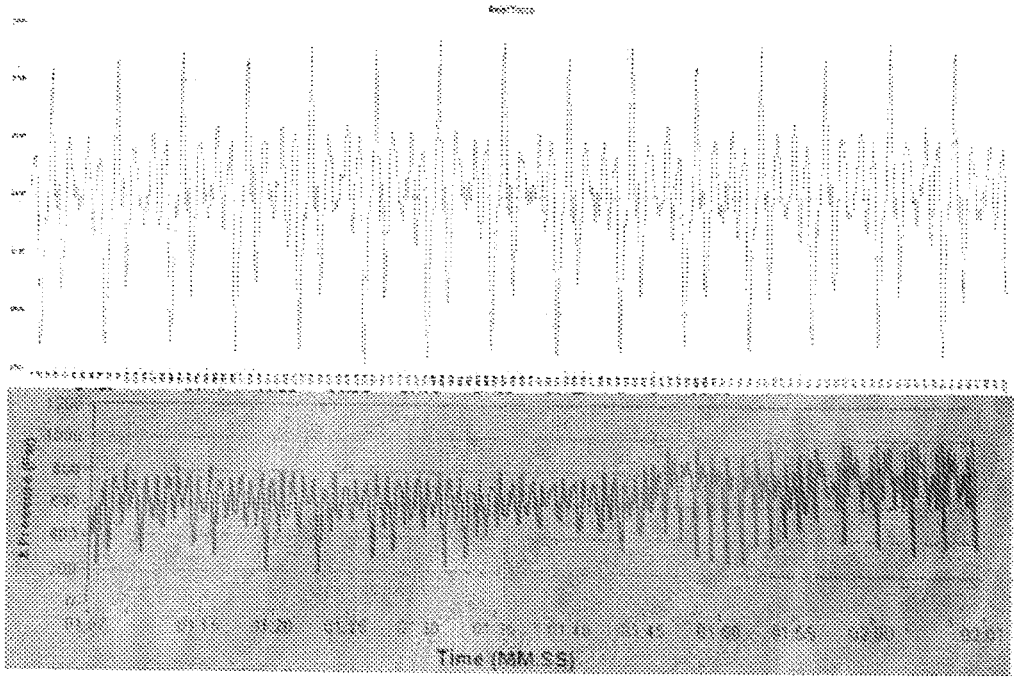
FIG. 10 provides graphical representations of pressure pulse magnitudes from the present tool (10A), the "AG-stator" tool (10B), and the "Rattler" tool (10C)
Figure 10B:
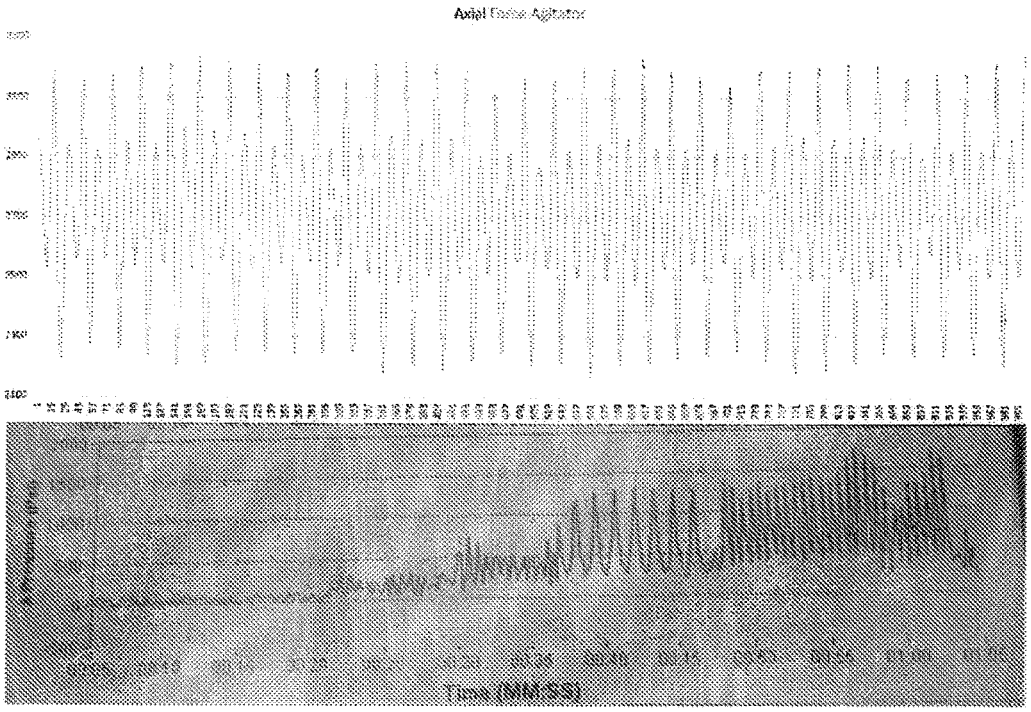
Figure 10C:
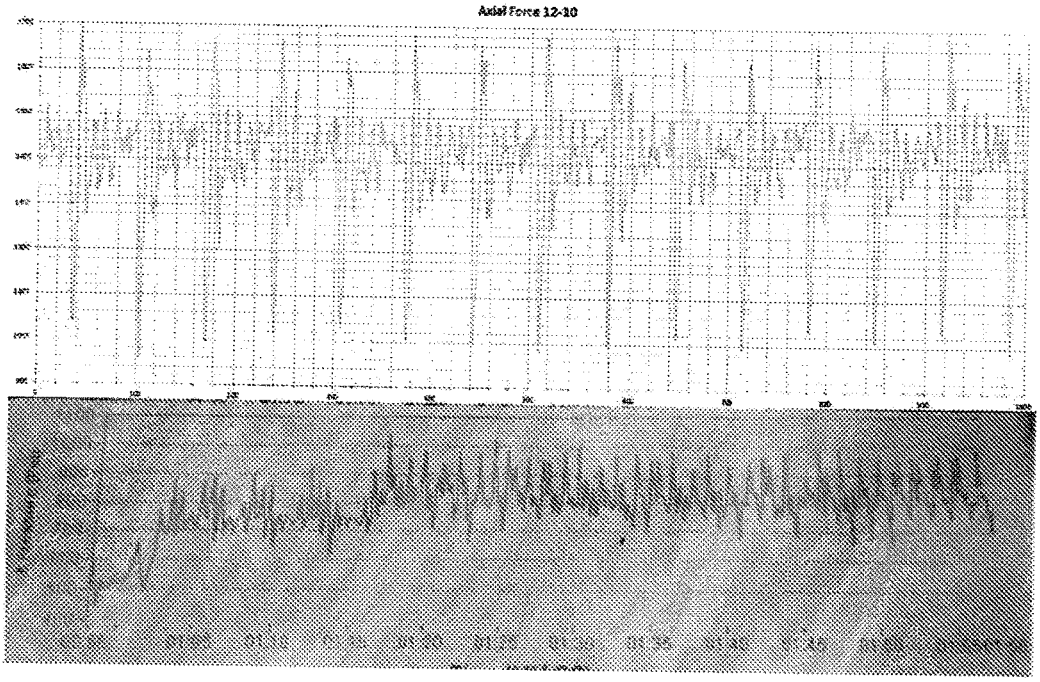
Figure 11:
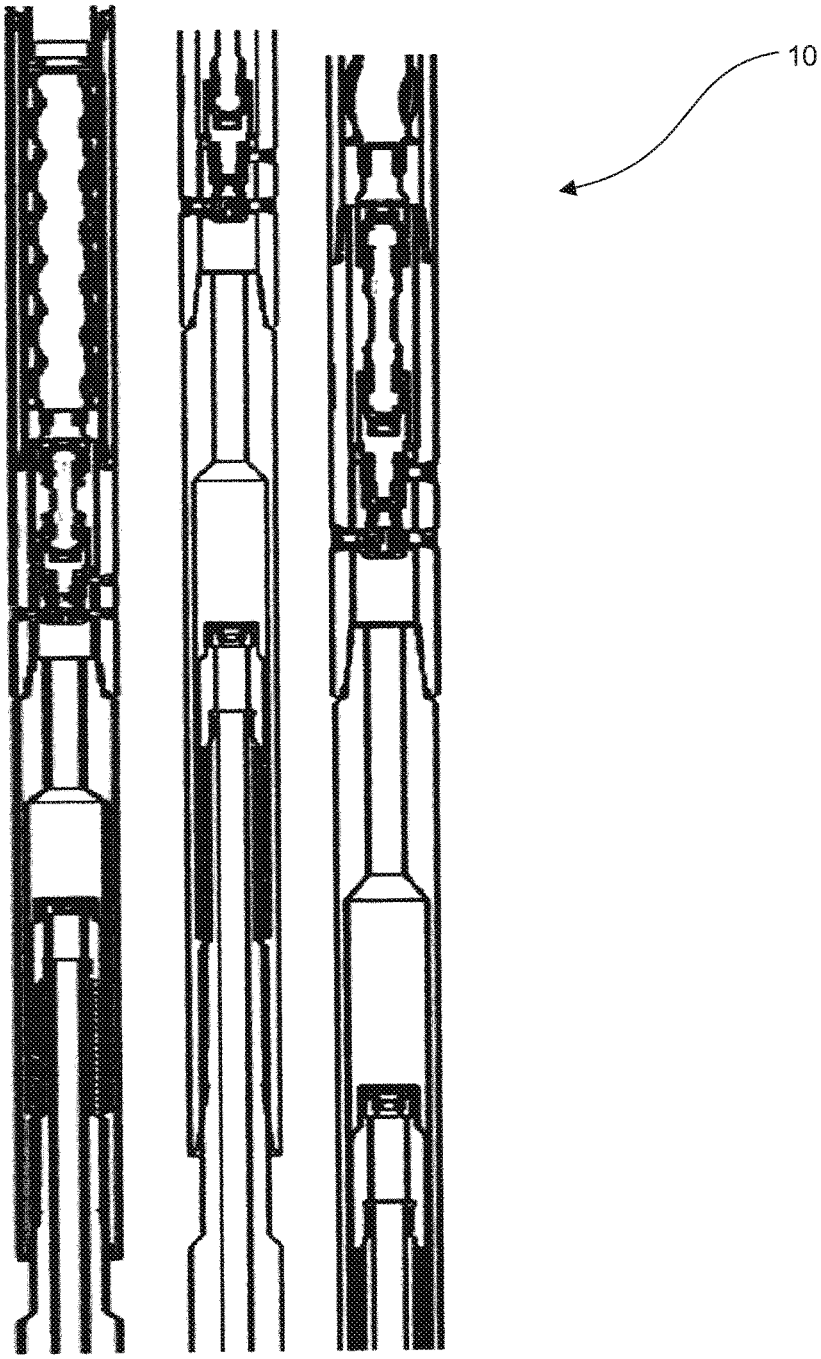
FIG. 11 provides alternative embodiments of the present tool having the fluid flow restrictor positioned within the mandrel of a shock sub.

Pressure pulse modification attainable by embodiments of the tool 10 is exemplified by comparing the pulse of the present tool 10 with known vibration tools, as shown in FIG. 10, FIG. 10A provides an example pressure pulse (axial) achieved by the present tool 10, said pulse having a maximum of approximately 1000 psi and a minimum of approximately 200 psi, for an overall pulse magnitude of approximately 800 psi in the negative direction. FIG. 10B provides an example of the same pressure pulse in FIG. 10A produced by the AG-itator tool disclosed in U.S. Pat. No. 8,167,051, commencing at a much lower minimum and increasing the backpressure within the tool to a maximum of approximately 1500 psi. As such, the AG-itator tool must create a much larger overall pressure loss (e.g. 1500 psi) at a fixed frequency to achieve the same overall pulse magnitude, increasing fatigue and failure of the tool. FIG. 10C provides an example of the same pressure pulse in FIG. 10A created by the tool disclosed in U.S. patent application Ser. No. 13/381,297, having a much lower overall pulse magnitude of 300 psi. These results demonstrate the ability of the present tool 10 to be utilized in various downhole applications, including as a hammer drill capable of imparting large, controlled pressure pulse vibrations to a drilling string in the upwards or downwards direction.

Various embodiments of the present tool 10 are contemplated such as, for example, where the positioning of the tool 10 along the drilling string, and/or the positioning of the contemplated elements within the tool 10, can be modified. In embodiments herein, the present tool may be used alone, in combination with other tools in a stacked arrangement, or in combination with one or more downhole tools. For example, having regard to FIG. 11, the present 10 is provided having the fluid flow restrictor 50 positioned within the mandrel of a shock sub.

Although a few embodiments have been shown and described, it will be appreciated by those skilled in the art that various changes and modifications might be made without departing from the scope of the invention. The terms and expressions used have been used as terms of description and not of limitation, and there is no intention in the use of such terms and expressions of excluding equivalents of the features shown and described or portions thereof, it being recognized that the invention is defined and limited only by the claims that follow.

The invention claimed is:

1. A tool for inducing negative pressure pulses to a drilling fluid transmitting downhole apparatus, the tool being adapted to permit the passage of the drilling fluid, comprising:

a tubular housing having a cylindrical wall forming a central bore extending through the housing with an upper inlet end and lower outlet end, and at least one first fluid port disposed through the wall, a positive displacement motor, positioned within the housing, a fluid vent assembly, positioned within the housing, connected to the positive displacement motor and movable therewith, the assembly having at least one second fluid port corresponding with the first fluid port, wherein when first and second fluid ports align at least a portion of the fluid is vented from the tool, and a fluid flow restrictor, positioned within the housing, operably connected to the venting assembly, the restrictor being a fixed or variable fluid port for controlling the velocity of at least a portion of the fluid flowing through the tool, increasing the fluid pressure within the tool, wherein, when the at least a portion of pressurized fluid is vented from the tool, the negative pressure pulse is induced.

2. The tool of claim 1 wherein the downhole apparatus comprises drill string, coil tubing, or casing string.

3. The tool of claim 1, wherein the tool is incorporated into the downhole apparatus.

4. The tool of claim 1, wherein the tool can be used to vibrate the downhole apparatus or as a motor in a percussion drill.

5. The tool of claim 1, wherein fluid is venting from the tool recurrently.

6. The tool of claim 1, wherein fluid flow restriction may be fixed or variable.

7. The tool of claim 1, wherein the fluid flow restrictor is positioned above, below or within the fluid vent assembly.

8. The tool of claim 1, wherein the variable fluid port may comprise a valve arrangement.

9. The tool of claim 1, wherein the valve arrangement may be a rotating, axially oscillating or orbiting valve arrangement.

10. A method of imparting a pressure pulse to a drilling fluid transmitting downhole apparatus, the method comprising:

causing fluid flow through a positive displacement motor housed within the apparatus, and controllably restricting velocity of at least a portion of the fluid flow through the apparatus by passing the fluid flow through a fixed or variable fluid flow port, increasing fluid pressure within the tool, while recurrently venting at least a portion of the restricted fluid from the downhole apparatus through a fluid vent assembly to create the pressure pulse.

11. The method of claim 10, wherein the flow of fluid is restricted in a fixed or variable manner.

12. The method of claim 10, wherein the venting of the fluid can be in a fixed or variable manner.

13. The method of claim 10, wherein manner of fluid flow restriction and venting dictate the amplitude and frequency of the pressure pulse.

14. The method of claim 10, wherein the pressure pulse profile can be tuned.

* * * * *